US006544128B1

(12) United States Patent
Yang

(10) Patent No.: US 6,544,128 B1
(45) Date of Patent: Apr. 8, 2003

(54) SWING DEVICE WITH AN AUTOMATIC DRIVING UNIT

(76) Inventor: Chih-Huang Yang, No. 1, Lane 47, Ta-An W. St., Hsi-Tun Dist., Taichung City (TW)

( * ) Notice: Subject to any disclaimer, the term of this patent is extended or adjusted under 35 U.S.C. 154(b) by 0 days.

(21) Appl. No.: 10/102,133

(22) Filed: Mar. 20, 2002

(51) Int. Cl.[7] ..... A63G 9/16
(52) U.S. Cl. ..... 472/119
(58) Field of Search ..... 472/118, 119, 472/120, 121, 122, 123, 124, 125; 297/273

(56) References Cited

U.S. PATENT DOCUMENTS 5,525,113 A * 6/1996 Mitchell et al. ..... 472/118
5,833,545 A * 11/1998 Pinch et al. ..... 297/273
5,846,136 A * 12/1998 Wu ..... 472/119
6,022,277 A * 2/2000 Jankowski ..... 472/119
6,059,667 A * 5/2000 Pinch ..... 297/273

* cited by examiner

*Primary Examiner*—Kien T. Nguyen
(74) *Attorney, Agent, or Firm*—Brinks Hofer Gilson & Lione

(57) ABSTRACT

A swing device includes a supporting frame, a seat unit pivoted to the supporting frame so as to be turnable relative to the supporting frame, and a driving unit mounted on the supporting frame and including a housing secured to the supporting frame, an axle disposed rotatably in and extending out of the housing and coaxially secured to the seat unit, and a swingable member disposed in the housing, coaxially secured to the axle, and swingable between first and second positions so as to permit synchronous swinging of the seat unit via the axle. A driving member is mounted securely in the housing and is connected to the swingable member in such a manner that actuation of the driving member results in synchronous swinging action of the swingable member and the seat unit when the swing device is operated in an automatic mode and that manual pushing of the seat unit results in synchronous swinging of the swingable member when the swing device is operated in a manual mode.

1 Claim, 9 Drawing Sheets

SWING DEVICE WITH AN AUTOMATIC DRIVING UNIT

BACKGROUND OF THE INVENTION

1. Field of the Invention

This invention relates to a swing device, more particularly to a swing device with an automatic driving unit that permits automatic and manual operations thereof.

2. Description of the Related Art

Conventional automatic lawn swings for small children normally include a support frame, a seat unit pivoted to the support frame so as to be swingable on the support frame, and a driving unit for swinging the seat unit. The driving unit uses an urging member that accumulates an amount of potential energy upon twisting in order to drive the seat unit via a mechanical linkage mechanism when released. The conventional lawn swing is disadvantageous in that it cannot be manually operated by pushing the seat unit due to resistance of the mechanical linkage mechanism. Moreover, the conventional lawn swing requires frequent twisting of the urging member, which is inconvenient and laborious.

SUMMARY OF THE INVENTION

Therefore, the object of the present invention is to provide a swing device with a driving unit that enables both automatic and manual operations of the swing device.

According to the present invention, a swing device comprises: a supporting frame; a seat unit having a seat member and a pair of opposing swing arms that are connected to the seat member and that are pivoted to the supporting frame so as to permit turning of the seat member relative to the supporting frame; and a driving unit mounted on the supporting frame and including a housing secured to the supporting frame, an axle disposed rotatably in and extending out of the housing and coaxially secured to one of the swing arms, a swingable member disposed in the housing, coaxially secured to the axle, and swingable between first and second positions so as to permit synchronous swinging of the seat unit via the axle, and a driving member mounted securely in the housing and connected to the swingable member in such a manner that actuation of the driving member results in synchronous swinging action of the swingable member and the swing arms when the swing device is operated in an automatic mode and that manual pushing of the swing arms results in synchronous swinging of the swingable member without interference from the driving member which is at an idle condition when the swing device is operated in a manual mode.

BRIEF DESCRIPTION OF THE DRAWINGS

In drawings which illustrate an embodiment of the invention.

DETAILED DESCRIPTION OF THE PREFERRED EMBODIMENT

Figure 1:
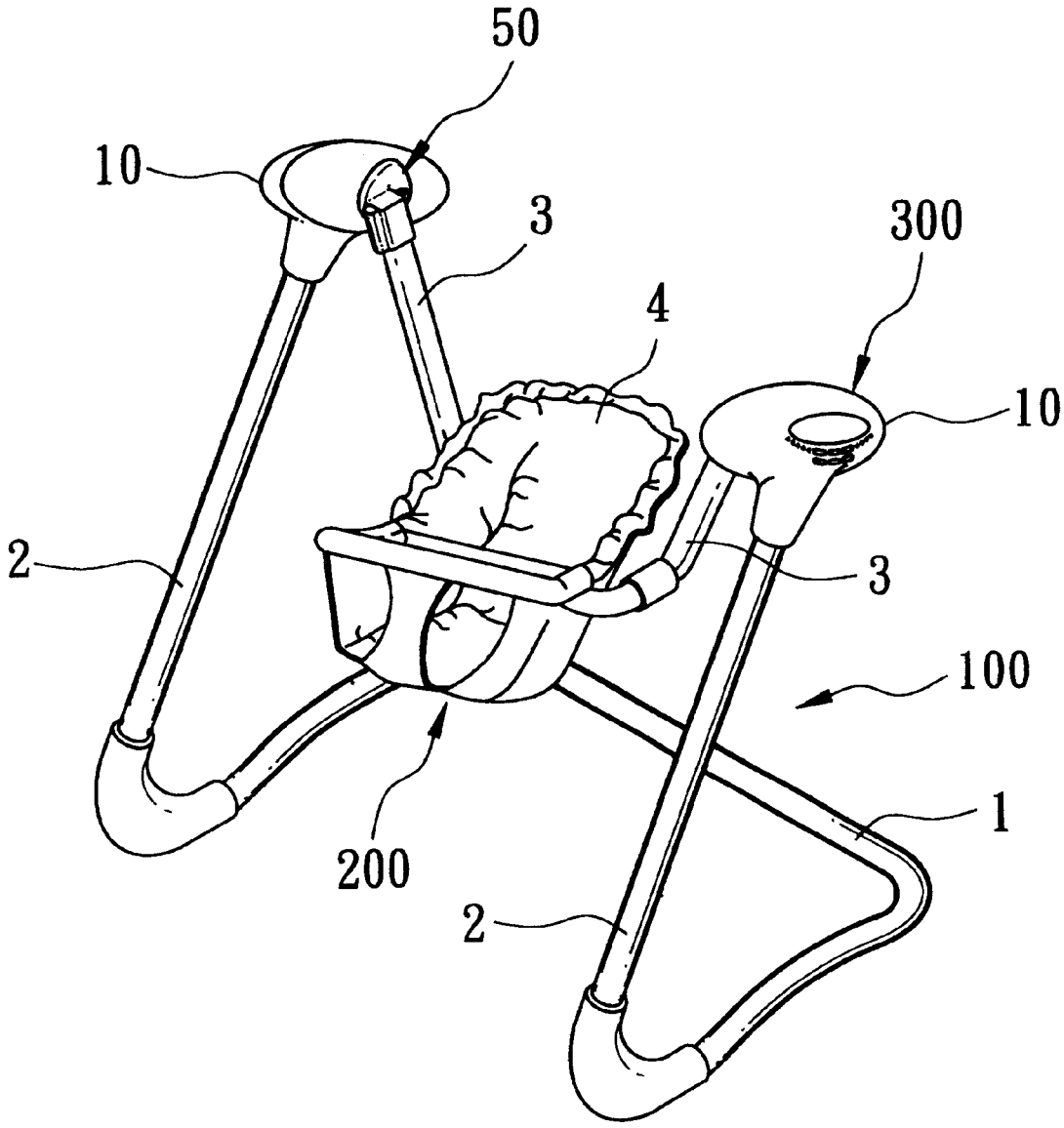
FIG. 1 is a perspective view of the preferred embodiment of a swing device according to this invention.
Figure 2:
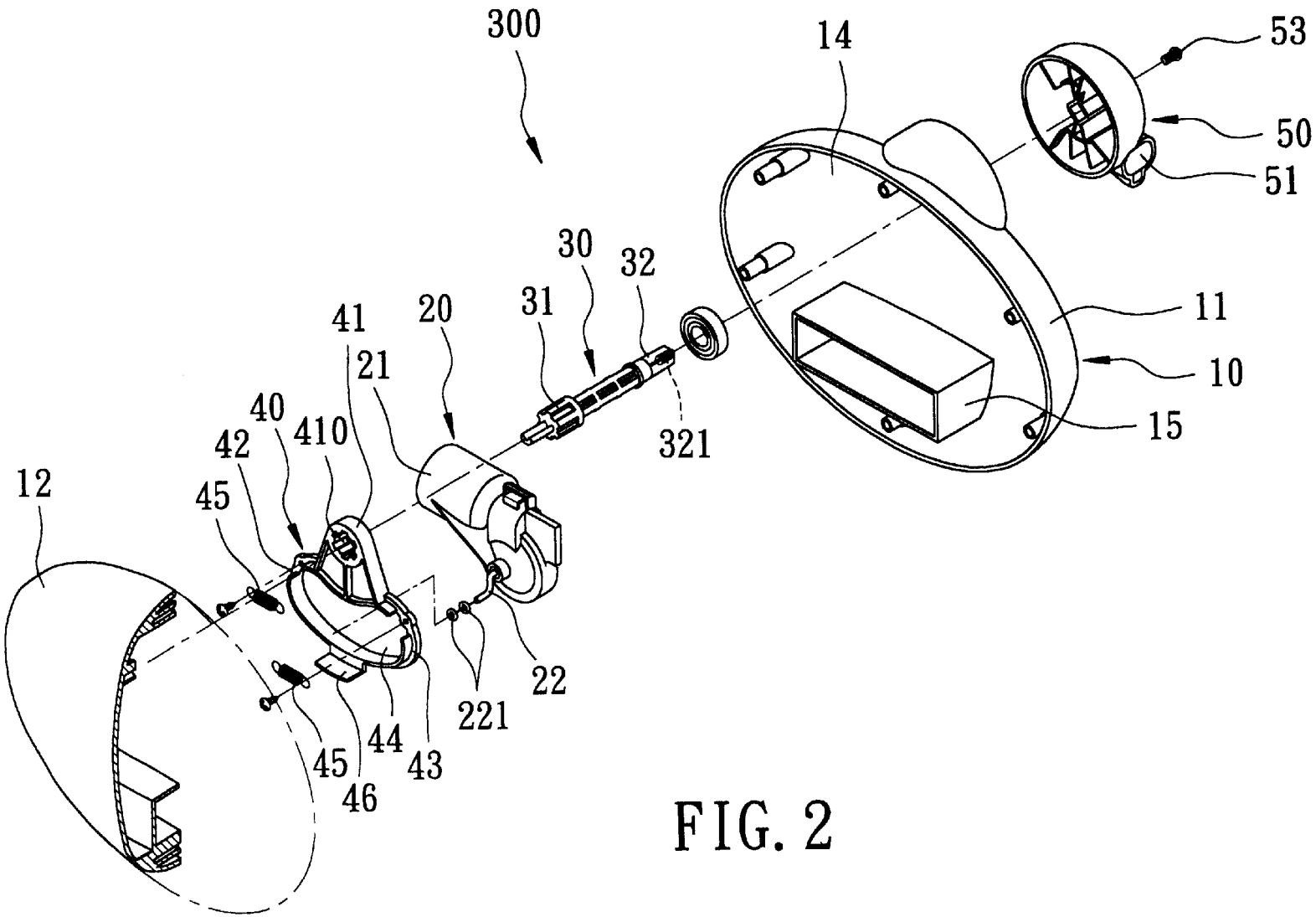
FIG. 2 is an exploded perspective view of a driving unit of the swing device of FIG. 1.
Figure 3:
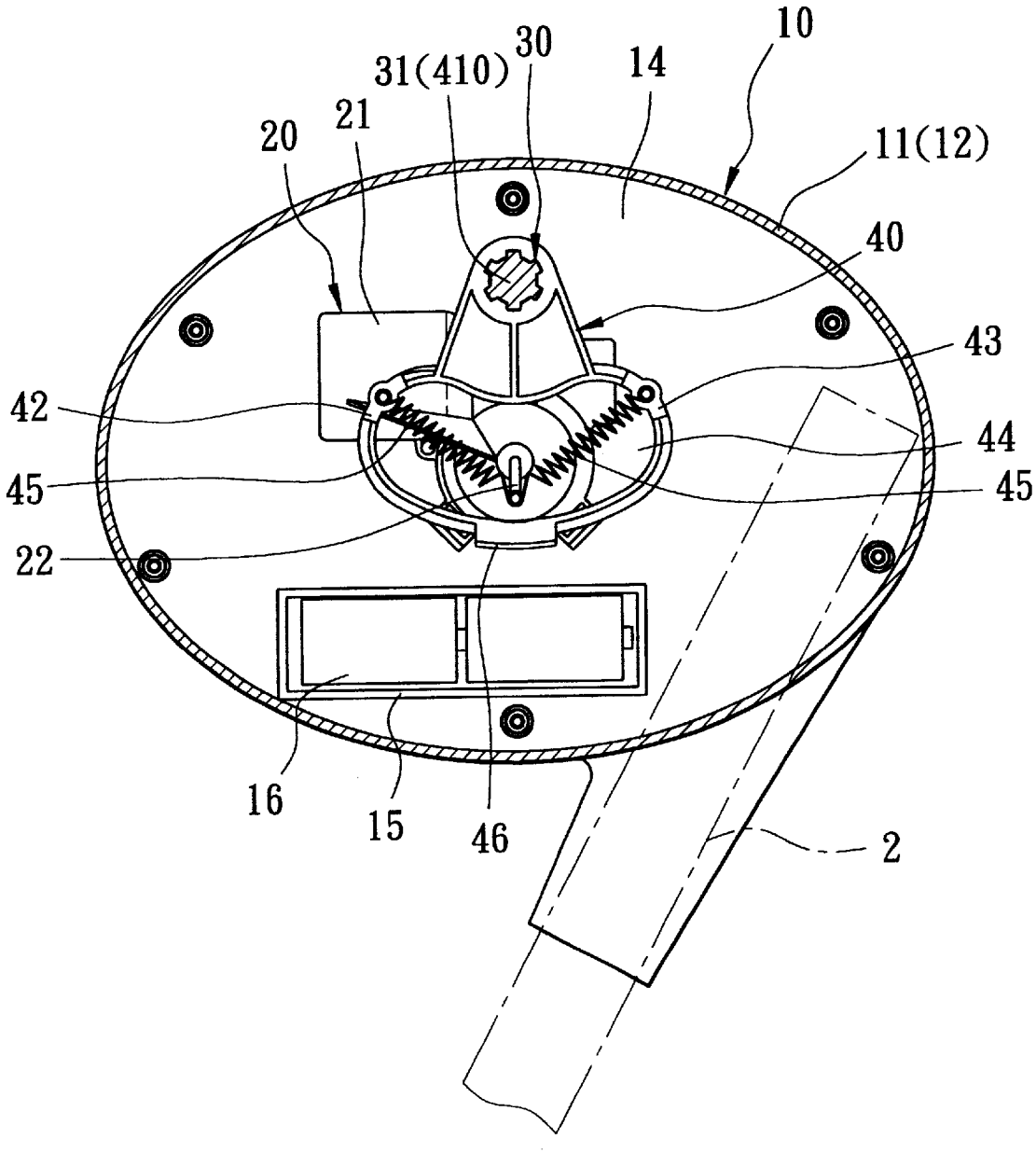
FIG. 3 is a sectional side view of the driving unit of FIG. 2.
Figure 4:
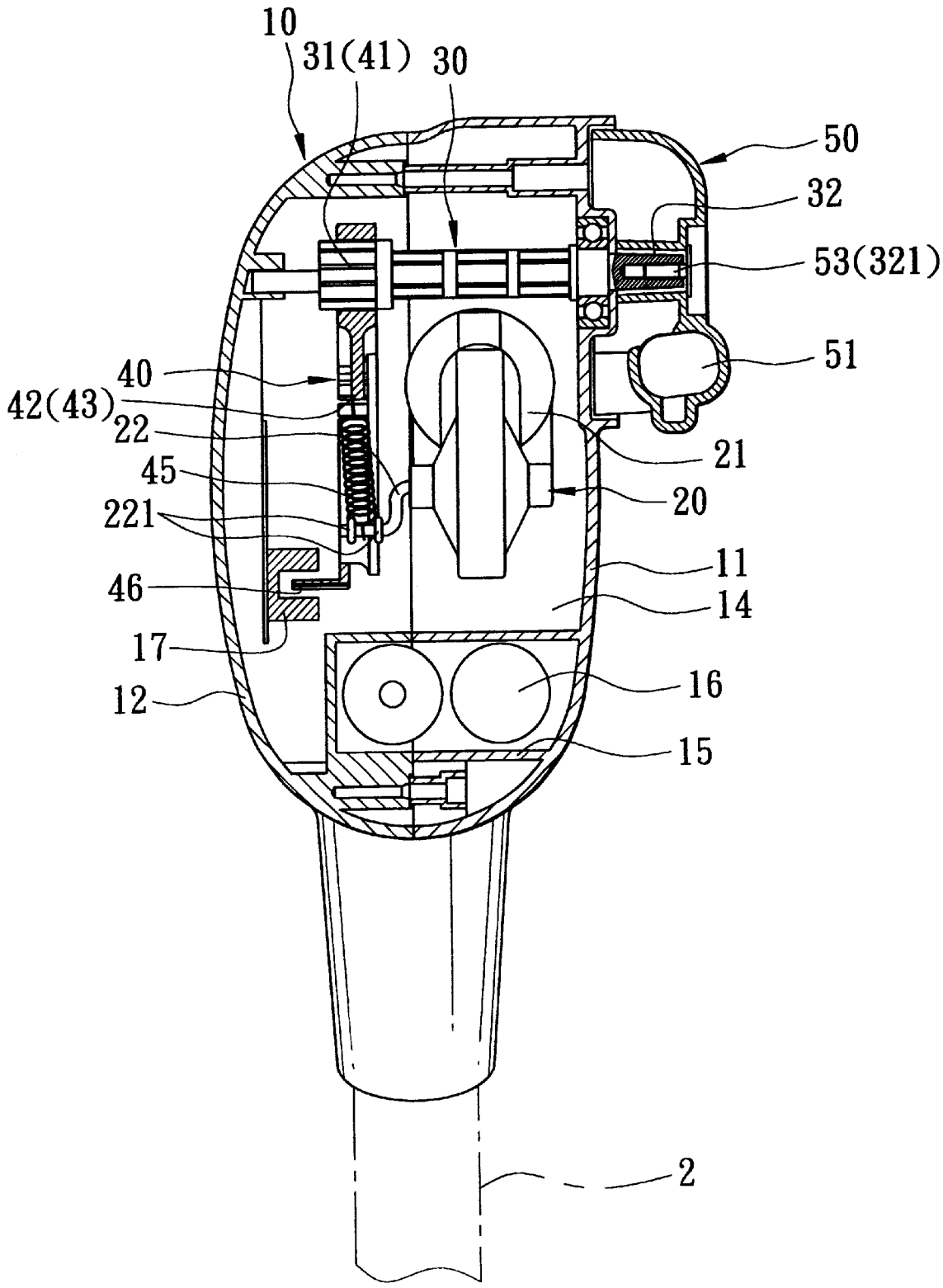
FIG. 4 is another sectional side view of the driving unit of FIG. 2.
Figure 5:
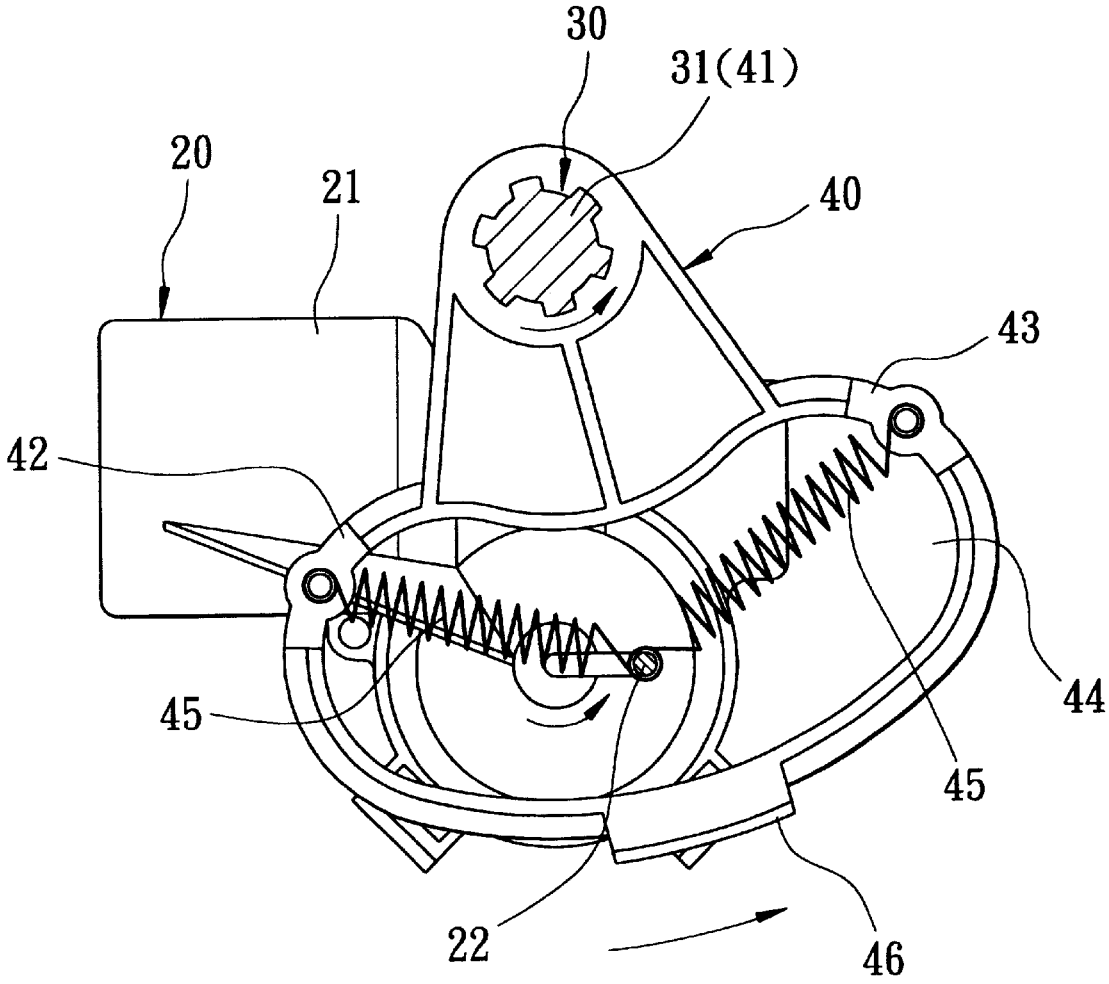
FIG. 5 is another sectional side view similar to FIG. 3, but with a swingable member of the driving unit disposed at a first position.
Figure 6:
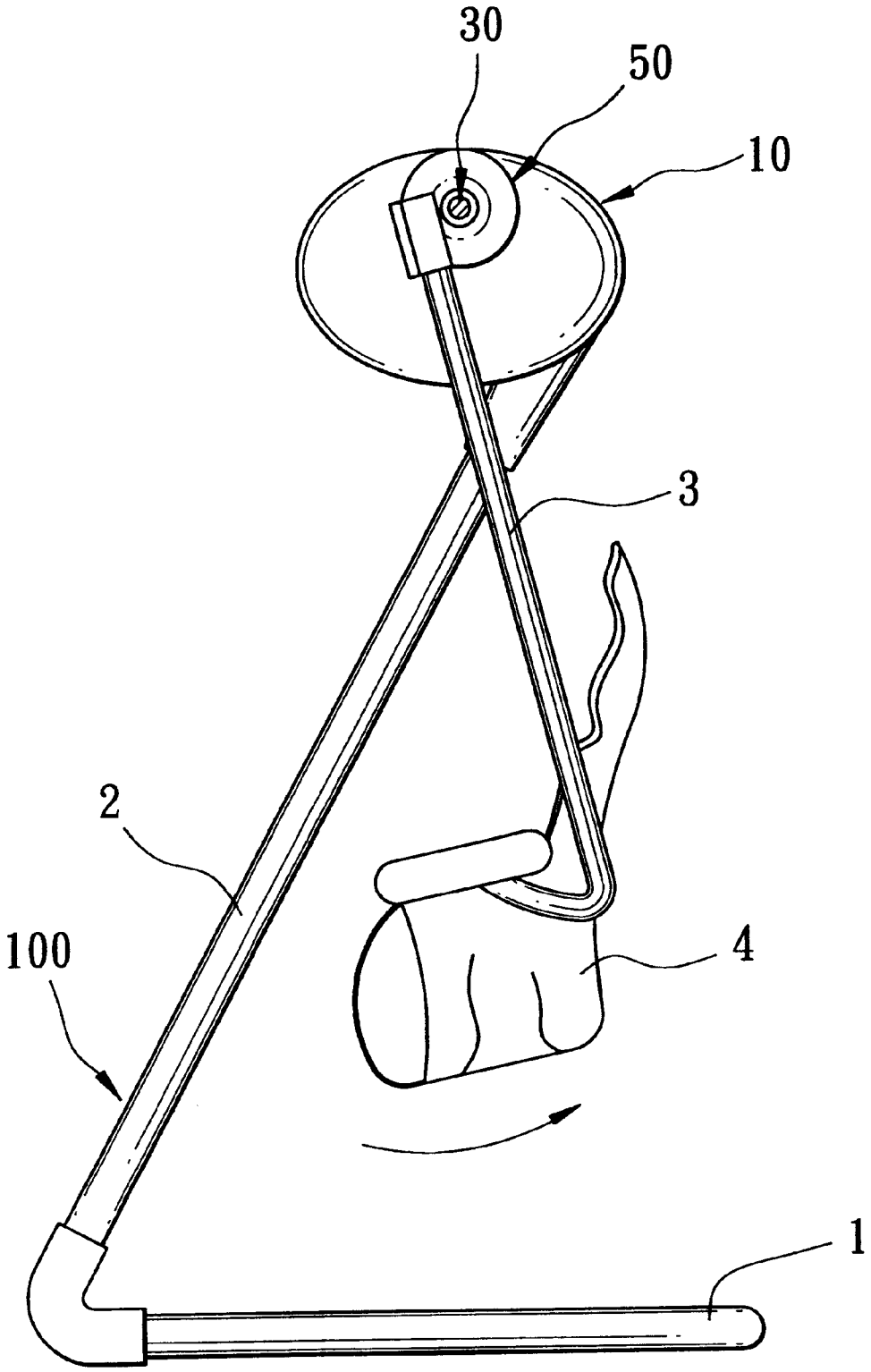
FIG. 6 is a side view of the swing device of FIG. 1, with the swingable member disposed at the first position.
Figure 7:
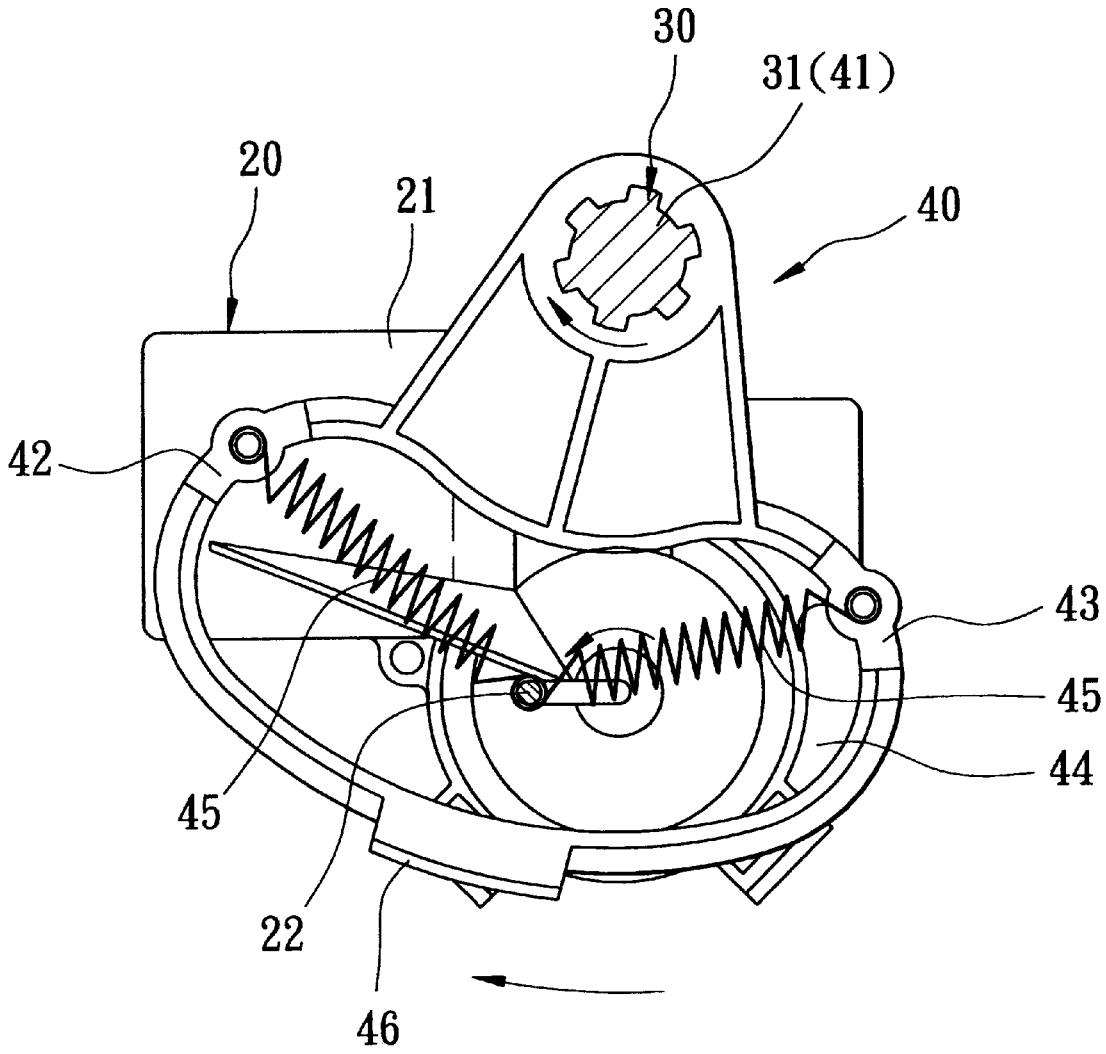
FIG. 7 is another sectional side view similar to FIG. 3, but with the swingable member disposed at a second position.
Figure 8:
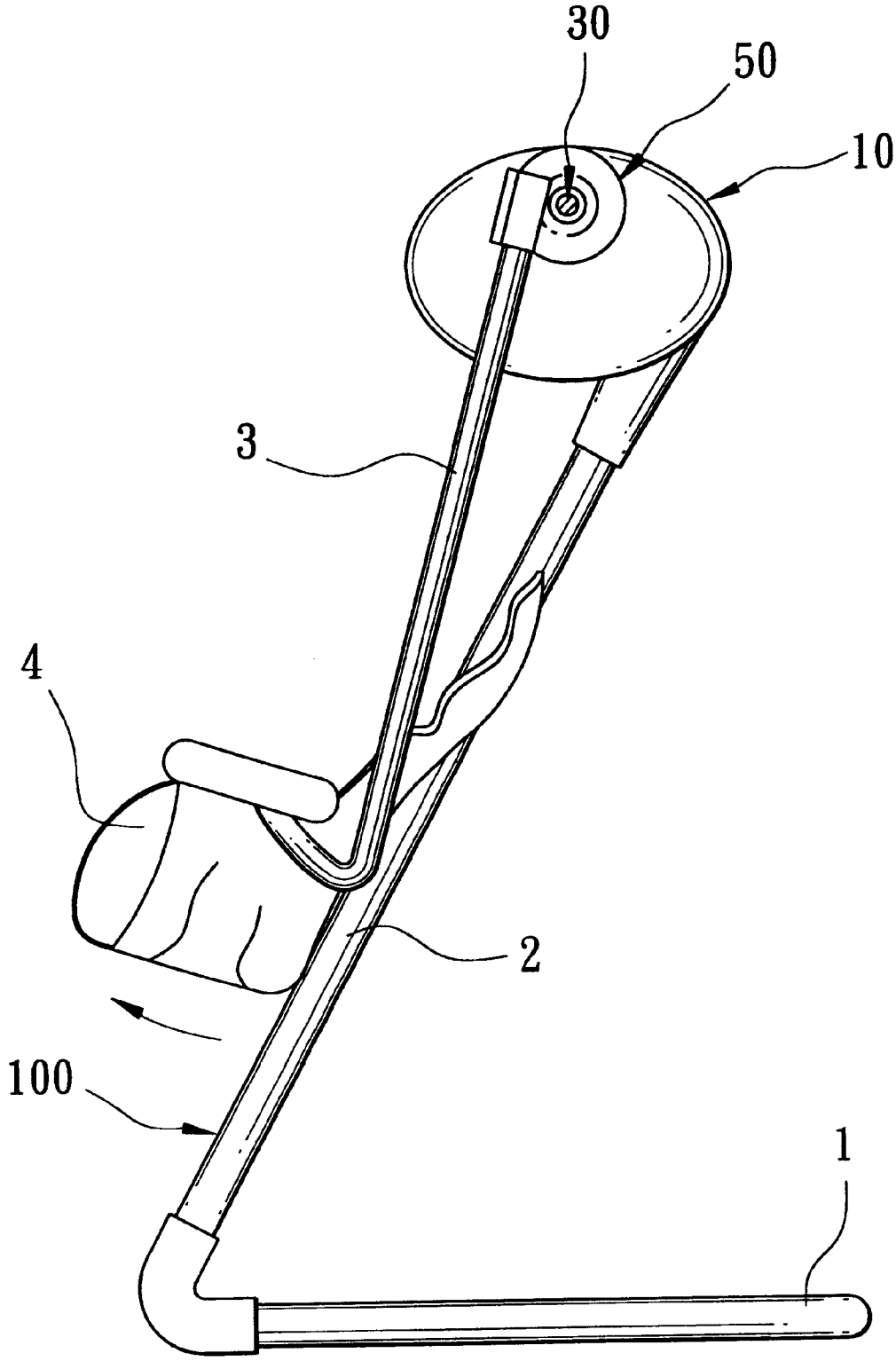
FIG. 8 is another side view of the swing device of FIG. 1, but with the swingable member disposed at the second position.

FIGS. 1 to 4 illustrate a preferred embodiment of a swing device of this invention.

The swing device includes: a supporting frame 100 including a U-shaped tubular base portion 1 which is to be laid on the ground surface, and a pair of tubular upright portions 2 extending upwardly and inclinedly from two opposite ends of the base portion 1; a pair of protective housings 10 secured to top ends of the upright portions 2; a seat unit 200 having a seat member 4 and a pair of opposing swing arms 3 that are connected to the seat member 4 and that are pivoted to the protective housings 10 on the supporting frame 100 via pivot members 50 so as to permit turning of the seat member 4 relative to the supporting frame 100; and a driving unit 300 mounted on the supporting frame 100 and including an axle 30 disposed rotatably in and extending out of a respective one of the housings 10 and coaxially secured to a respective one of the swing arms 3, a swingable member 40 disposed in the respective housing 10, coaxially secured to the axle 30, and swingable between first and second positions (see FIGS. 5 to 8) so as to permit synchronous swinging of the seat unit 200 via the axle 30, and a driving member 20 mounted securely in -the respective housing 10 and connected to the swingable member 40 in such a manner that actuation of the driving member 20 results in synchronous swinging action of the swingable member 40 and the swing arms 3 when the swing device is operated in an automatic mode and that manual pushing of the swing arms 3 results in synchronous swinging of the swingable member 40 without interference from the driving member 20 which is at an idle condition when the swing device is operated in a manual mode.

Each of the housings 10 includes first and second halves 11, 12 that complement to each other and that confine therebetween a mounting space 14. A battery chamber 15 is formed in the mounting space 14 for receiving a set of batteries 16. The axle 30 has one end 32 that is formed with a screw hole 321 and that extends out of the respective housing 10 to securely connect with the respective pivot member 50 via screw means 53 extending through the screw hole 321, and the other end formed with a toothed annular flange 32. Each of the pivot members 50 has a bowl-shaped part and a tubular connecting part 51 projecting from the bowl-shaped part and secured to a respective one of the swing arms 3.

The driving member 20 includes a motor 21 with an output crank 22. The swingable member 40 includes an intermediate portion 41 formed with an engaging hole 410 that engages the toothed annular flange 31 so as to permit the intermediate portion 41 to be coaxially and securely connected to the axle 30, and two opposing side portions 42, 43 projecting oppositely from two opposite sides of the intermediate portion 41 and defining therebetween a spring-mounting space 44. The output crank 22 extends into the spring-mounting space 44. The driving unit 300 further includes a pair of opposing coil springs 45, each of which is disposed in the spring-mounting space 44 and each of which is connected to the output crank 22 and a respective one of the side portions 42, 43 so as to permit the swing device to be operated between the automatic and manual modes. A pair of retaining O-rings 221 are sleeved on the output crank 22 in order to retain the coil springs 45 on the output crank 22.

A sensor unit (17, 46) is mounted in the mounting space 14 for detecting the swinging action of the swingable member 40, and includes a light sensitive sensor 17 disposed adjacent to the swingable member 40, and a detected member 46 secured to and projecting from the side portions 42, 43 to a position above the light sensitive sensor 17 so as to permit the light sensitive sensor 17 to detect the swinging action of the swingable member 40 by sensing the change in the intensity of light therearound each time the detected member 46 passes over the light sensitive sensor 17.

With reference to FIGS. 5 to 8, when the swing device is operated in the automatic mode, rotation of the output crank 22 results in alternate pulling of the side portions 42, 43 of the swingable member 40 via the respective coil springs 45, which, in turn, results in synchronous swinging of the seat unit 200 via the axle 30.

Figure 9:
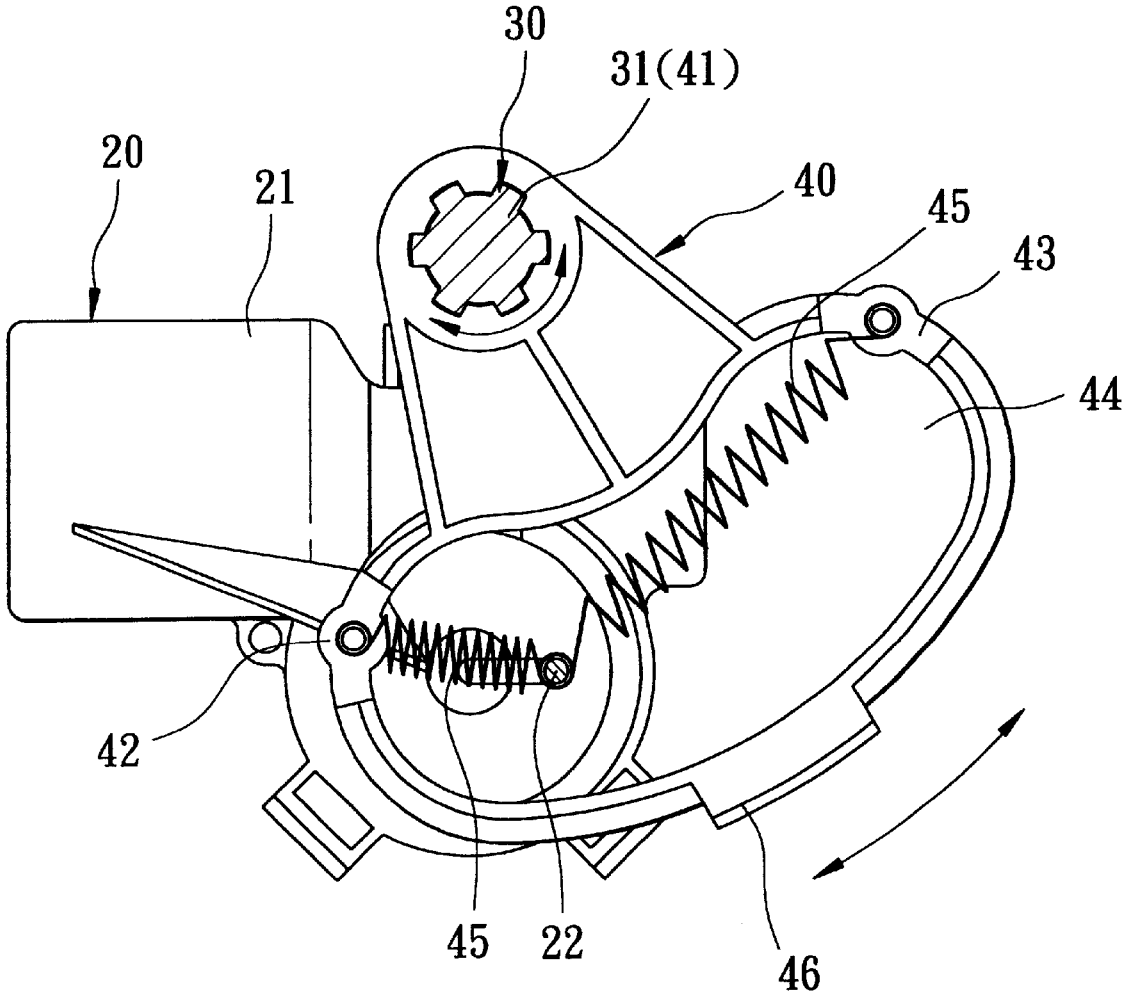
FIG. 9 is a sectional side view to illustrate how the swingable member swings when the swing device of FIG. 1 is operated in a manual mode.

With reference to FIG. 9, when the swing device is operated in the manual mode, pushing of the swing arms 3 results in synchronous swinging of the swingable member 40 via the axle 30, which, in turn, results in alternate extension and compression of the coil springs 45 via the side portions 42, 43, while the output crank 22 remains idle at this time. Since the coil springs 45 are alternately compressed and extended during the pushing of the swing arms 3, manual swinging of the swing unit 200 is permitted without being hindered by the output crank 22, thereby eliminating the aforesaid drawback as encountered in the prior art.

With the invention thus explained, it is apparent that various modifications and variations can be made without departing from the spirit of the present invention. It is therefore intended that the invention be limited only as recited in the appended claims.

I claim:

1. A swing device comprising:

supporting frame;

a seat unit having a seat member and a pair of opposing swing arms that are connected to said seat member and that are pivoted to said supporting frame so as to permit turning of said seat member relative to said supporting frame;

a driving unit mounted on said supporting frame and including a housing secured to said supporting frame, an axle disposed rotatably in and extending out of said housing and coaxially secured to one of said swing arms, a swingable member disposed in said housing, coaxially secured to said axle, and swingable between first and second positions so as to permit synchronous swinging of said seat unit via said axle, and a driving member mounted securely in said housing and connected to said swingable member in such a manner that actuation of said driving member results in synchronous swinging action of said swingable member and said swing arms when said swing device is operated in an automatic mode and that manual pushing of said swing arms results in synchronous swinging of said swingable member without interference from said driving member which is at an idle condition when said swing device is operated in a manual mode; and wherein said driving member includes a motor with an output crank, said swingable member including an intermediate portion coaxially connected to said axle, and two opposing side portions projecting oppositely from said intermediate portion and defining therebetween a spring-mounting space, said output crank extending into said spring-mounting space, said driving unit further including a pair of opposing springs, each of which is disposed in said spring-mounting space and each of which is connected to said output crank and a respective one of said side portions so as to permit said swing device to be operated between said automatic and manual modes.

* * * * *